United States Patent [19]

Burkhard et al.

[11] Patent Number: 4,634,064

[45] Date of Patent: Jan. 6, 1987

[54] PROCESS FOR FORMING A THREAD-RESERVE WINDING

[75] Inventors: Ludwig Burkhard; Edmund Schuller, both of Ingolstadt; Kurt Lovas, Böhmfeld; Rupert Karl, Ingolstadt, all of Fed. Rep. of Germany

[73] Assignee: Schubert & Salzer Maschinenfabrik Aktiengesellschaft, Ingolstadt, Fed. Rep. of Germany

[21] Appl. No.: 679,565

[22] Filed: Dec. 7, 1984

[30] Foreign Application Priority Data

Dec. 9, 1983 [DE] Fed. Rep. of Germany ..... 3344646

[51] Int. Cl.[4] ..... B65H 54/02; B65H 54/34

[52] U.S. Cl. ..... 242/18 PW; 57/263

[58] Field of Search ..... 242/18 PW, 18 DD, 18 A, 242/25 A; 57/299, 263, 400, 404

[56] References Cited

U.S. PATENT DOCUMENTS

| | | | |
|---|---|---|---|
| 3,858,816 | 1/1975 | Corbiere | 242/18 PW |
| 3,974,972 | 8/1976 | Egli et al. | 242/18 PW |
| 4,002,305 | 1/1977 | Takeuchi et al. | 242/18 PW |
| 4,084,759 | 4/1978 | Piro | 242/18 PW |
| 4,102,507 | 7/1978 | Hoffmann et al. | 242/18 PW |
| 4,105,165 | 8/1978 | Miyazaki et al. | 242/18 PW |
| 4,195,788 | 4/1980 | Miyazaki et al. | 242/18 PW |
| 4,351,492 | 9/1982 | Aoyama et al. | 242/18 PW X |
| 4,354,642 | 10/1982 | Schewe | 242/18 PW |
| 4,362,260 | 12/1982 | Hasegawa et al. | 242/18 R X |
| 4,466,575 | 8/1984 | Husges et al. | 242/18 PW |

*Primary Examiner*—Stanley N. Gilreath
*Attorney, Agent, or Firm*—Dority & Manning

[57] ABSTRACT

A thread-reserve winding is formed on a bobbin tube of a spinning machine in which the thread is drawn off continuously from the spinning machine by means of a pair of draw-off rollers and, to form the thread-reserve winding, is grasped and wound onto the bobbin tube. According to the invention, immediately after the thread has been grasped, the spinning tension is put into effect to wind on the thread-reserve winding and, after the thread-reserve winding has been applied, the thread is wound on under the normal winding-on tension. In this way, the thread is drawn off by the bobbin tube under a thread tension sufficient to ensure a taut winding.

4 Claims, 2 Drawing Figures

FIG.1

PROCESS FOR FORMING A THREAD-RESERVE WINDING

BACKGROUND OF THE INVENTION

The present invention relates to a process for forming a thread-reserve winding on a bobbin tube of a spinning machine, in which the thread is drawn off continuously from the spinning machine by means of a pair of draw-off rollers containing a pressure roller. The thread is conveyed into a thread-suction device before the start of the thread-reserve winding. It is then brought into a thread transfer position, in which it intersects the plane of rotation of a thread-catching device rotating together with the bobbin tube where it is grasped by the said thread-catching device and is then cut off.

In producing bobbins filled with thread, it is generally customary before the start of the bobbin build-up first to wind a thread reserve on one end of the bobbin tube, in order subsequently to be able to join together the thread ends of individual complete bobbins and thus draw off the yarn uninterruptedly from a plurality of bobbins. At the same time, the thread reserve has to be wound onto the bobbin tube so securely that, when the bobbin is handled, it does not become loose or slip off from the tube and thus become a disturbing factor.

However, in a spinning machine, for example on open-end spinning machines, in which the thread is drawn off continuously and delivered to the winding-on device, difficulties arise in meeting the requirement that the thread reserve should be wound onto the bobbin tube securely. These difficulties occur because the thread is not traversed during the formation of the thread-reserve winding, and therefore the length of the thread wound on the bobbin tube during formation of the thread reserve winding is less than the length of the thread delivered from the spinning device by the draw-off rollers. Consequently, between the bobbin tube and the pair of draw-off rollers drawing off the thread from the spinning machine, there is no thread tension necessary for ensuring that the thread reserve is wound on securely.

A solution to this problem in an open-end spinning machine is described U.S. Pat. No. 4,501,116 on which the invention is based. According to this known proposal, the excess length of supplied thread, which occurs during the formation of the thread-reserve winding, is stored immediately in a pneumatic thread store and is used up again, at the start of the bobbin build-up during the normal winding of the bobbin as a result of the traversing of the thread over the length of the tube. However, in addition to the additional outlay caused by a pneumatic thread store and an increased air consumption, this process is also unsatisfactory as regards the tautness of the thread-reserve winding.

SUMMARY OF THE INVENTION

The object of the present invention is to provide a process which avoids the disadvantages of the known proposal and which makes it possible in a simple way to form a sufficiently secure thread-reserve winding on a bobbin.

This object is achieved, according to the invention because, immediately after the thread has been grasped, the thread is released from the draw-off rollers and pulled from the spinning device solely by the bobbin tube to wind on the thread-reserve turns and, after the thread-reserve winding has been applied, the thread is wound on the bobbin tube in the usual traversing manner which provides winding-on tension.

This ensures that, during the formation of the thread-reserve winding, the thread is drawn off by the bobbin tube under a thread tension sufficient to obtain a taut winding.

Preferably, during the period of formation of the thread-reserve winding, the thread is released from the draw-off rollers and pulled solely by the bobbin tube when the pressure roller of the pair of draw-off rollers is lifted and, after the thread reserve winding has been applied to the bobbin tube, the pressure roller is advanced to its drive roller again. If the pressure roller is lifted intermittently during the formation of the thread-reserve winding, the thread tension and consequently the tautness of the reserve winding can be influenced. In a further form of the process according to the invention, the reserve turns are wound over a portion of the cut-off thread while the thread is released by the draw-off rollers and pulled solely by the bobbin tube.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figures 1, 2:
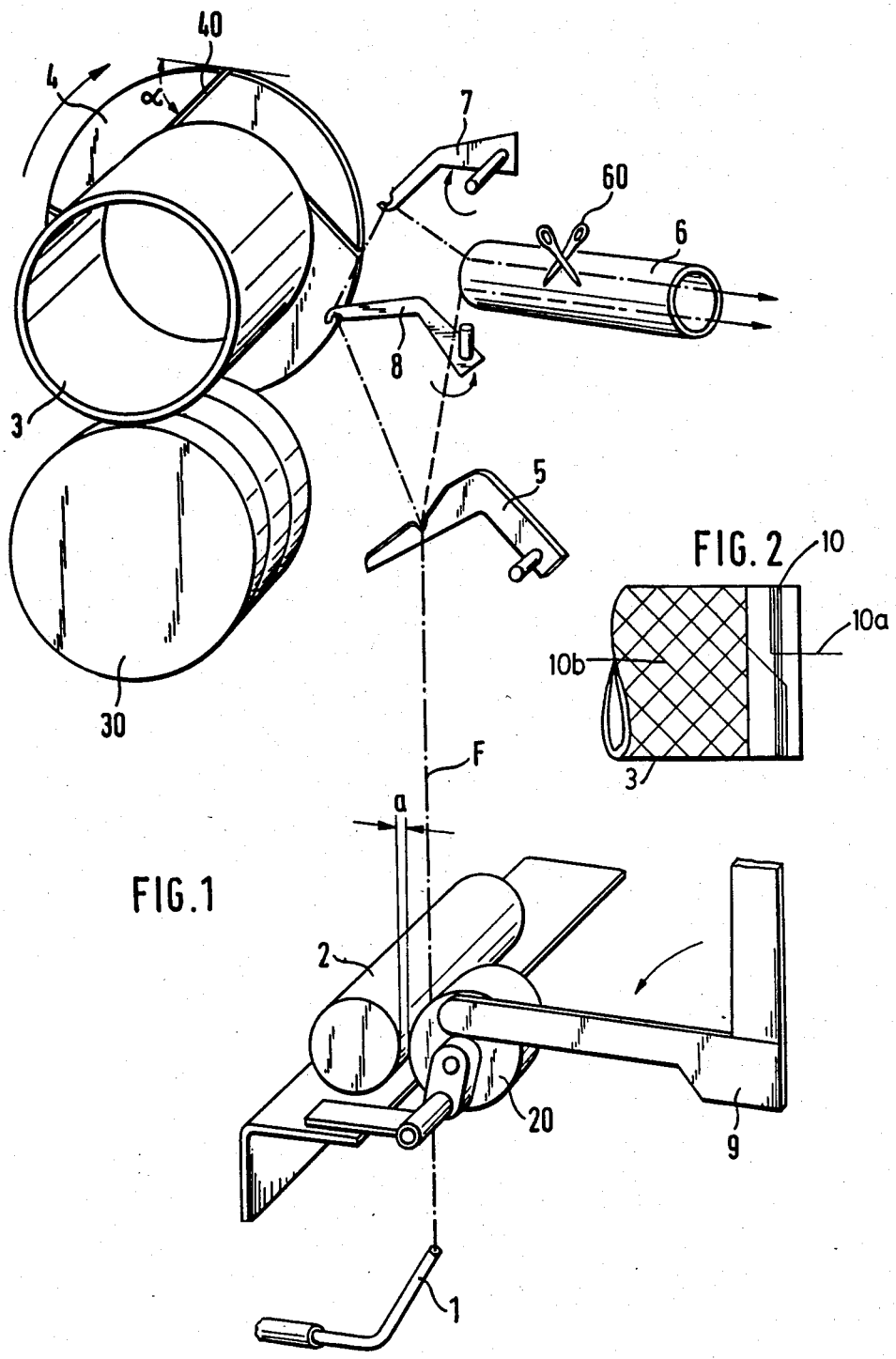
FIG. 1 shows in a perspective representation the parts of an open-end spinning machine together with an associated winding-on device.
FIG. 2 shows a portion of a bobbin tube with a thread reserve wound over it.

The invention is not restricted to open-end spinning machines, but can also be used advantageously on other spinning machines from which the thread is drawn off by a pair of draw-off rollers, irrespective of the method of thread feeding and reserve formation.

The tension used according to the invention for winding on the thread-reserve turns can be put into effect in various ways, for example by ejecting the thread out of the nip line of the pair of draw-off rollers after it has been grasped by the thread catching device. However, the thread is preferably subjected to tension because the pressure roller of the pair of draw-off rollers is lifted so that the thread is drawn from the spinning device solely by the bobbin tube.

The following description is restricted to the delivery of thread in front of the spooling station and to the formation of the thread-reserve winding. The process steps preceding these measures, such as the joining of the thread sent back from the bobbin, the removal of the leader and the exchange of the bobbin for an empty tube, are described by way of example in U.S. Pat. No. 4,501,116 so that there is no need to discuss these again here.

In FIG. 1, reference numeral 1 denotes the thread draw-off pipe of an open-end spinning machine, through which the spun thread F is drawn off continuously. The thread is drawn off by means of a pair of draw-off rollers which consists of a drive roller 2 and a pressure roller 20.

Of the winding-on device, only a bobbin tube 3 with a bobbin plate 4 and its drive roller 30 are shown; however, the bobbin tube 3 is held rotatably in a known way between two arms which press it against the drive roller 30. For receiving and centering the bobbin tube 3, each of the two bobbin arms possesses a bobbin plate rotating together with the bobbin tube 3, and of these the bobbin plate 4 illustrated has several slits 40 arranged on its periphery and serving as a thread-catching device. The slits 40 form their entrance at an acute angle $\alpha$ with the tangent to the periphery of the bobbin plate 4.

The handling and guidance of the thread F before and during its transfer to the bobbin tube 3 correspond to the operations described in U.S. Pat. No. 4,501,116. The thread guide 5 described in FIG. 2 of the U.S. Pat. No. 4,501,116 corresponds to the thread guide fork 5 in FIG. 1 which is located in front of the bobbin tube 3. The only difference is that the thread guide fork 5 is not displaceable. Furthermore, the thread suction pipe 6, connected to a vacuum source (not shown) and having a thread cut-off device 60 in the vicinity of its mouth, corresponds to the mouth 40 of the thread suction device 4 in U.S. Pat. No. 4,501,116. This cutting device can be arranged inside the pipe or, as shown in U.S. Pat. No. 4,501,116, also outside the pipe. Since the thread guide fork 5 is arranged fixed in place, a thread deflector 8 guides the thread as the result of a pivoting movement for the purpose of forming the reserve turns. Moreover, a pivotable thread lifter 7 is provided near the outside of the bobbin plate 4. These apparatus parts are arranged on a moveable servicing trolley and are brought into position accordingly in front of the winding-on device in order to exchange a complete bobbin for an empty tube and transfer to this empty tube the thread coming from the spinning machine.

After the complete bobbin has been removed and an empty tube inserted for winding, the thread F drawn off continuously from the thread draw-off pipe 1 by the draw-off rollers 2, 20 runs first into the thread suction pipe 6, being guided on its way there, as indicated by broken line, by the thread guide fork 5. At this moment, the thread guide fork 5 is located in the same radial plane in which the thread-reserve winding is to be wound onto the part of the bobbin tube 3 intended for it. Subsequently, the thread lifter 7 is swung up so that the thread conveyed into the thread suction pipe 6 passes into the effective range of the thread cut-off device 60 located near the suction orifice of the thread suction pipe 6, and at the same time the thread deflector 8 pivots in the direction of the bobbin tube 3 and over its portion earmarked for the reserve winding. Consequently, the thread portion located between the thread lifter 7 and the thread deflector 8 is in a position in which it intersects the plane of rotation of the thread-catching slits 40 on the periphery of the bobbin plate 4 rotating together with the bobbin tube 3 and is thereby caught by one of these slits. Immediately after this, the thread in the thread suction pipe 6 is severed by the thread cut-off device 60 and the severed thread end is sucked up, while the thread portion extending to the bobbin plate 4 is taken up by the latter.

As soon as the thread is grasped by one of the thread-catching slits 40 and thus fixed on the tube 3, the pressure roller 20 of the pair of draw-rollers is lifted off from the drive roller 2 (the distance a). The pair of draw-off rollers is consequently put out of operation and the tension in the thread is created by the rotating bobbin withdrawing the thread from the spinning device. The rotating bobbin 3 itself takes over the draw-off of the thread from the spinning machine. During the formation of the thread-reserve winding which now follows, the tension, to which the thread is subjected when drawn off by the bobbin tube 3, ensures that the thread-reserve winding is wound onto the bobbin tube securely. The thread is drawn off by the bobbin tube during the period of the winding-on of the thread reserve 10 which is preferably applied to the bobbin tube in such a way that the reserve winding is wound over a portion of the cut off thread 10*a* (FIG. 2). This overwinding takes place after the thread deflector 8 has released the thread by being pivoted away in the direction of the bobbin plate 4, shortly after the thread has started to be taken up by the bobbin tube and after the thread guide fork 5 located in the radial plane of the thread-reserve winding has taken over the thread guidance.

The tension in the thread changes immediately after the thread-reserve turns have been applied. Such occurs shortly before the thread released by the thread guide fork 5 is grasped by the traversing thread guide (not shown) of the winding-on device and thread traversing for the bobbin build-up begins. For this purpose, the pressure roller 20 of the pair of draw-off rollers is brought up against the drive roller 2 again, so that the thread is drawn off from the spinning machine by the pair of draw-off rollers. The thread is now grasped by the traversing thread guide and wound onto the bobbin tube as indicated at 106. The tension in the thread during winding on the bobbin results from the difference between the delivery speed of the draw-off rollers and the winding-on speed of the bobbin.

In principle, the pressure roller 20 can be actuated manually. If an automatic servicing device is provided, an appropriate control mechanism acts on the lever 9. As a result, the pressure roller 20 can also be lifted off intermittently, and the thread tension and consequently also the tautness of the reserve winding can be influenced during the formation of the reserve turns by the frequency with which the lever 9 is actuated.

We claim:

1. A process for forming a thread-reserve winding on a bobbin tube of a spinning device in which the thread is drawn off continuously from the spinning device by means of a pair of draw-off rollers containing a pressure roller and, to form a thread-reserve winding, is grasped and wound onto the bobbin tube, comprising the steps:

(a) releasing the thread from the draw-off rollers immediately after the thread has been grasped, (b) pulling the thread from the spinning device solely by rotation of the bobbin tube;

(c) forming the thread-reserve winding on the bobbin tube;

(d) bringing the thread again in clamping contact with the draw-off rollers after the thread-reserve winding has been applied; and (e) delivering the thread by the draw-off rollers to the bobbin tube for winding thereon.

2. A process as claimed in claim 1, wherein the step of releasing the thread from the draw-off rollers includes lifting the pressure roller of the pair of draw-off rollers and, after the thread reserve winding has been applied, the step of bringing the thread again in clamping contact with the draw-off rollers includes bringing the pressure roller back into contact with the drive roller.

3. A process as claimed in claim 2, wherein the step of forming the thread-reserve winding on the bobbin tube includes intermittently lifting the pressure roller.

4. A process as claimed in claim 1, wherein the step of forming the thread-reserve winding on the bobbin tube includes winding the reserve turns over a portion of the cut off thread after releasing the thread from the draw-off rollers.

* * * * *